US007537447B2

(12) United States Patent
Teague

(10) Patent No.: US 7,537,447 B2
(45) Date of Patent: May 26, 2009

(54) ATMOSPHERIC GAS BURNER MADE OF BIOSOLUBLE AND GEL-CAST CERAMIC FIBERS

(75) Inventor: Timothy Teague, Sylvania, OH (US)

(73) Assignee: Thermic Investments S.A., Luxembourg (LU)

( * ) Notice: Subject to any disclaimer, the term of this patent is extended or adjusted under 35 U.S.C. 154(b) by 0 days.

(21) Appl. No.: 11/498,977

(22) Filed: Aug. 2, 2006

(65) Prior Publication Data

US 2006/0269880 A1 Nov. 30, 2006

Related U.S. Application Data

(63) Continuation of application No. 10/484,760, filed as application No. PCT/EP02/08625 on Aug. 1, 2002, now abandoned.

(60) Provisional application No. 60/371,337, filed on Apr. 9, 2002, provisional application No. 60/309,579, filed on Aug. 2, 2001.

(51) Int. Cl.
*F23Q 2/32* (2006.01)

(52) U.S. Cl. ..... 431/125; 431/328; 431/326; 126/512

(58) Field of Classification Search ..... 431/125, 431/328, 326; 126/92 B, 512, 92 AC
See application file for complete search history.

(56) References Cited

U.S. PATENT DOCUMENTS

| | | | | |
|---|---|---|---|---|
| 3,275,497 | A | 9/1966 | Weiss et al. | |
| 4,869,664 | A | 9/1989 | Wright et al. | |
| 5,320,520 | A | 6/1994 | Barth et al. | |
| 5,328,356 | A | 7/1994 | Hawkinson | |
| 5,400,765 | A | 3/1995 | Goldstein et al. | |
| 5,927,270 | A | 7/1999 | McDonald | |
| 5,931,154 | A | 8/1999 | Hussong et al. | |
| 6,045,356 | A | 4/2000 | Hunter et al. | |
| 6,383,421 | B1 | 5/2002 | Phipps | |
| 2004/0170938 | A1 * | 9/2004 | Teague | 431/125 |
| 2006/0269880 | A1 * | 11/2006 | Teague | 431/125 |

FOREIGN PATENT DOCUMENTS

| | | |
|---|---|---|
| EP | 0 267 671 | 5/1988 |
| EP | 0 519 718 | 12/1992 |
| EP | 0 848 796 | 6/1998 |
| JP | 02251430 | 3/1989 |

* cited by examiner

*Primary Examiner*—Alfred Basichas
(74) *Attorney, Agent, or Firm*—Merchant & Gould P.C.

(57) ABSTRACT

The present invention is related to a gas burner capable of bringing artificial "fuel" disposed thereon to incandescence, known as a "living-flames" gas burner, for use in a single-heating appliance, comprising a multi-panel element made of rigid gel-cast molded ceramic fibers or of bio-soluble ceramic fibers.

12 Claims, 3 Drawing Sheets

ATMOSPHERIC GAS BURNER MADE OF BIOSOLUBLE AND GEL-CAST CERAMIC FIBERS

This application is a continuation of U.S. application Ser. No. 10/484,760, filed on Jan. 22, 2004, which is a National Stage of PCT/EP02/08625, filed on Aug. 1, 2002, which claims priority to U.S. provisional Application 60/309579 filed on Aug. 2, 2001 and 60/371337 filed on Apr. 9, 2002, which applications are encorporated herein by reference.

FIELD OF THE INVENTION

The present invention is related to a new so-called "living flames" gas burner, i.e. a gas burner which flames heat up artificial "fuels" (giving a wood or coal look) to a particular degree of incandescence.

STATE OF THE ART

Examples of "living flames" gas burners are described in prior art documents, such as U.S. Pat. No. 5,328,356 and EP-0 848 796-B1.

These burners generally comprise metallic elements or pieces. Prior art designs use a metal mounting platter and unstable fastenings. The metal pieces are able to withstand high temperatures. Other non-metallic materials such as asbestos fibers or ceramic fibers resist at very high temperatures but are, or are suspected to be carcinogenic and should be avoided, especially in view of the manufacturing operations.

However, new technologies are coming more available such as gel-cast molded and so-called "bio-soluble" ceramic fibers. Gel-cast ceramics, i.e. ceramics processed by sol-gel technique, is a rigid dense material, using stable bonding solutions to significantly reduce the possibility for airborne fiber exposure. For example, bio-soluble ceramics is only bio-soluble (or has low biopersistence) for a firing period of 14 hours at 1000° F.

U.S. Pat. No. 5,400,765 describes a gas-fired stove wherein the burner comprises a porous ceramic fibers surface. The ceramics composition includes a narrow band emitting substance such as rare earth metal oxide. This invention is advantageously carried out in applications such as cooking, as the absorption spectrum of food and water nearly matches such an emission spectrum. Moreover, the selected emission may be passed through a glass top which is not significantly heated thereby. The flat porous ceramic burner comprises a skeleton support, for example made of a metal screen or perforated metal, covered by a series of ceramic fiber layers. The burner comprises a burner tube and head in which the gas-air mixture is mixed and ignited for heating the top surface made of porous ceramic fibers. These tube and head are also made of metal for sustaining high temperatures and for recuperation of the heat from the exhausting flue products flowing externally along the burner.

The problem of such a composite ceramics/metal burner, is that high amounts of heat are communicated by conduction or radiation to adjacent pieces such as the gas-feeding venturi system. Moreover the burner assembly has a non-flat combustion chamber and is voluminous owing to the heat recuperation circuitry of the flue gases which requires the presence of insulation walls.

In document EP-A-0 519 718, one discloses a simulated solid fuel gas burner comprising an upper ceramic fiber board spaced above a lower metal tray by a resilient strip of ceramic fiber blanket, to form a chamber for receiving the gas/air mixture fed from a venturi injector supported beneath the base of the tray by a metal bracket fixed to said base. In this case again, the heat is communicated by the tray by conduction to the feeding system, providing thereon high temperature conditions prohibiting the use of common seals such as polymer seals or the use of electronic control devices.

AIMS OF THE INVENTION

The present invention aims to provide a "living flames" gas burner which is distinct from those of prior art in its overall material composition and design.

Additionally, the invention aims at providing a gas burner manufactured in materials which are known for not presenting carcinogenic properties and/or for providing significant exposure reduction for the consumer to airborne fibrous particles.

Another purpose of the invention is to provide a gas burner possibly devoid of any metal piece.

SUMMARY OF THE INVENTION

The gas burner system according to the present invention comprises refractory ceramics constituted of gel-cast molded fibers. Alternatively bio-soluble ceramic fibers can also be used. Its thickness may advantageously be comprised between 7 and 40 mm.

Biosoluble fibers can dissolve in physiological fluids. This last characteristic allows these fibers to be distinguished from asbestos fibers or ceramic fibers known to be the source of pulmonary problems for the people manipulating them (i.e. during cutting operations).

These fibers may be under the form of rigid, self-supporting insulation boards or panels, have various properties such as good heat and thermal shock resistance, low thermal conductivity (which provides low and stable temperature of the primary air/gas mixture in the inner volume of the burner) as well as good mechanical resistance.

According to the invention, the rigid gel-cast or biosoluble ceramic fiber panels are air-tightly assembled by all means known per se, e.g. joint, screw, rivet, glue, etc.

Artefacts of solid fuel (wood, coal) made out of heat-resistant concrete, refractory fibers, etc., are optionally provided on the burner upper plate.

SHORT DESCRIPTION OF THE DRAWINGS

In the drawings, the same reference numbers represent the same or similar elements.

DESCRIPTION OF PREFERRED EMBODIMENTS OF THE INVENTION

Figure 1:
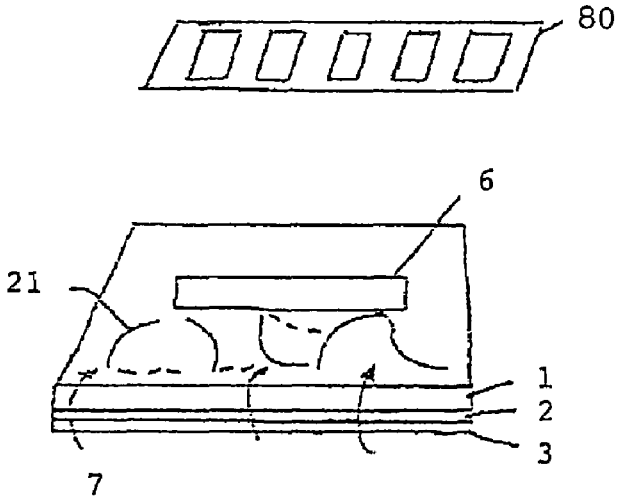
FIG. 1 represents a perspective view of a first preferred embodiment of the gas burner according to the present invention.
Figure 3:
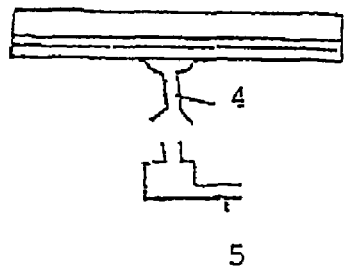
FIG. 3 represents a cross-sectional view of the gas burner of FIG. 1.
Figure 2:
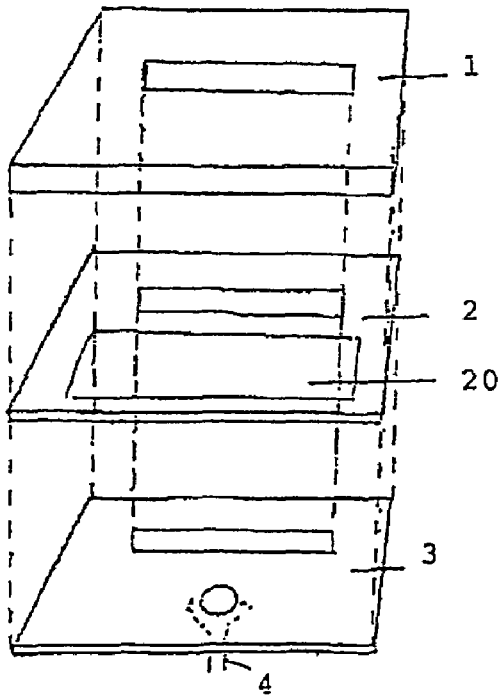
FIG. 2 represents an exploded view of the different ceramic fibers plates composing the gas burner of FIG. 1.

A first preferred embodiment of the present invention is illustrated in FIG. 1. A burner is made of three air-tightly connected biosoluble or gel-cast ceramic fiber panels (FIG. 2): an upper panel 1 overhanging an empty inner volume 20 in a middle panel 2 and a lower panel 3, wherein a venturi tube 4 is connected (FIG. 3).

The fuel (gas)/oxidizer (primary air) mixture is brought in the inner volume 20 through the venturi tube which provides the primary air suction by gas injection 5. Furthermore, secondary air is horizontally brought to the front 7 and to the back 6 of the burner.

On the one hand, this operation allows turbulence when secondary air meets the rising flow of the burnt gases, which results in the homogenization of the fuel (gas)/oxidizer (air) mixture, and on the other hand, it allows the cooling of the flames at their base, which makes them "weaker" as compared to real wood or coal flames.

The upper plate 1 presents additional holes (and/or slits) 21 which, on the one hand, are close enough to each other to cross-light the flames coming out of said holes and, on the other hand, have a section/depth ratio such as to avoid the backdraft in the inner volume. Moreover, these holes are disposed along a very specific cutting path 21 in order to favor said cross-lighting.

The burner of the invention can be advantageously provided with a deflector 80 made of the same material, i.e. gel-cast ceramic fibers or ceramic fibers that are soluble in physiological fluids. This deflector is specifically adapted to said burner and has oxidizing properties, which render the flue gases cleaner.

A further surprising and unexpected advantage of the invention lies in the discovery that the use of deflector 80 provides a reduction of carbon dioxide content in the flue gases. Moreover, it was shown experimentally that this "catalytic" property is not dependent on the fuel used (wood, gas, oil, etc.).

Figure 4:
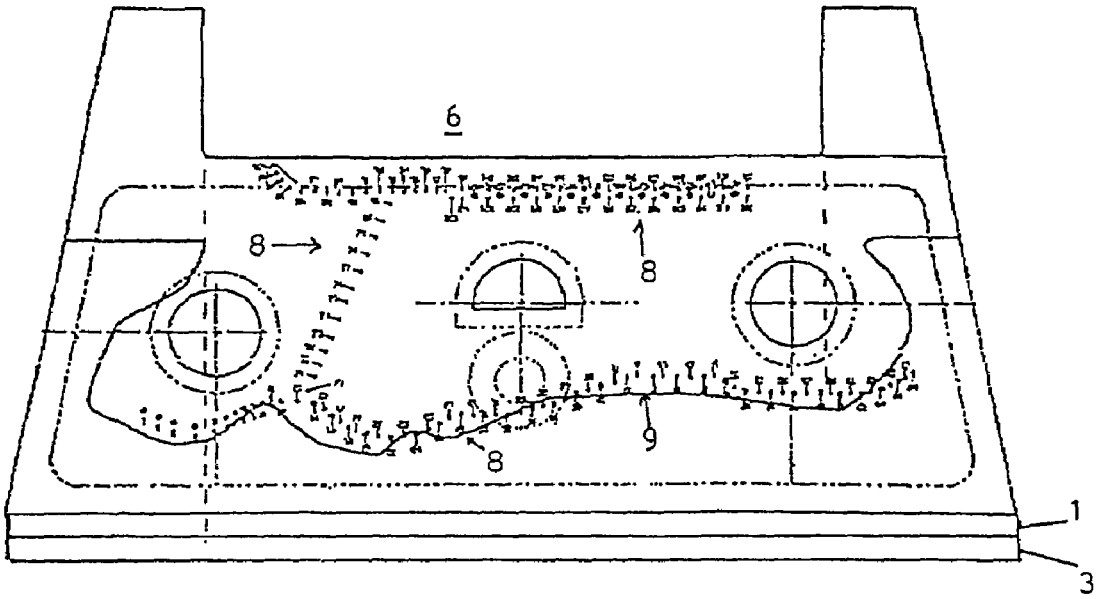
FIG. 4 represents a perspective view of a second preferred embodiment of the gas burner according to the present invention.
Figure 5A:
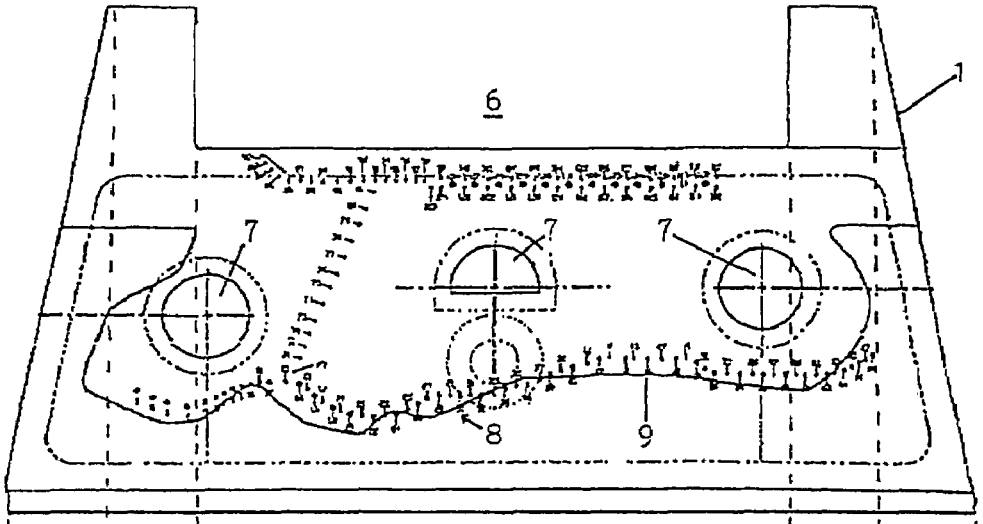
FIGS. 5A and 5B represent a view of both upper and lower rigid gel-cast ceramic fibers panels composing the gas burner of FIG. 4.

A second preferred embodiment of the present invention is illustrated in FIG. 4. A burner is made of two air-tightly connected rigid gel-cast ceramic fiber panels (FIG. 5). Biosoluble ceramic fiber panels may also be used, but currently the market-available material is still very expensive and this limits its industrial attractivity.

Figure 6:
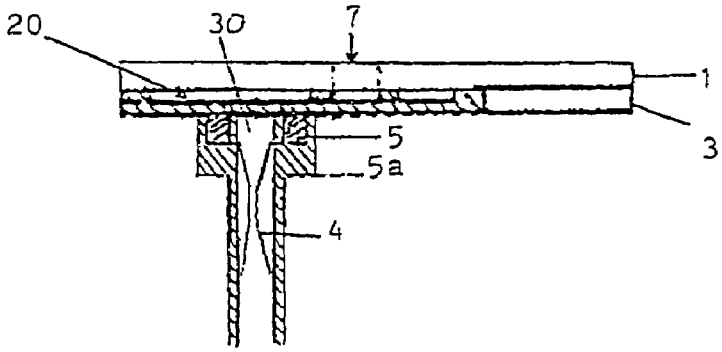
FIG. 6 represents a cross-sectional view of the gas burner of FIG. 4.
Figure 5B:
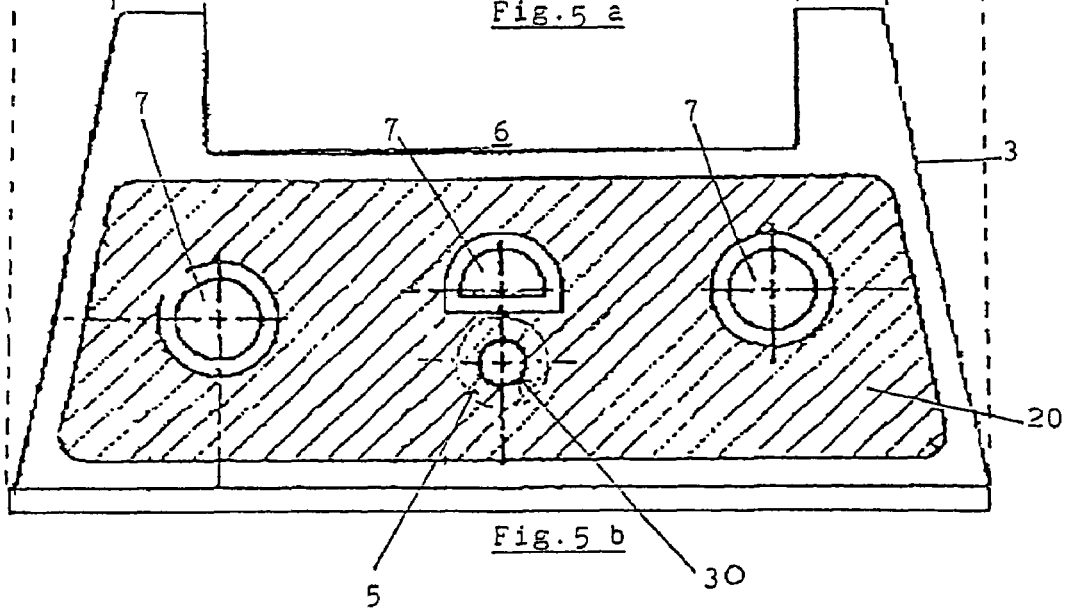

According to the burner of the invention, a top portion (FIG. 5A) comprising an upper panel 1 is overhanging a bottom portion (FIG. 5B) comprising a lower panel 3, which has been hollowed out to create an air to fuel mix chamber 20, and presenting also a hole 30 to fit a venturi tube 4 (FIG. 5B). The venturi tube is thus connected to the bottom of the stove and the burner seats upon it (FIG. 6).

The bottom portion of the burner is designed to mate with the top portion using stable fastenings for completing it into a one piece burner system. A third cast fiber ceramic piece 5, attached to the bottom portion of the burner, has specific dimensions to act as a receptacle for the venturi supply system 4. The venturi system is mounted to the bottom interior of the stove, with a double cup receptacle 5,5A.

The top of the upper panel 1 (FIG. 5A), presents a very detailed surface topography 9 which resembles ashes and ember chunks and logs formed onto a "real" wood or coal burner surface. Moreover artificial logs may be disposed on this upper surface (not shown).

The fuel (gas)/oxidizer (primary air) mixture is brought into the void 20 through the venturi tube which provides the primary air suction by gas injection. The gas/primary air mixture is brought to the upper surface of the burner by a series of holes and/or slits 8 pierced in the upper panel 1 and connected to the mix chamber 20.

Preferably, these holes (and/or slits) 8 are close enough to each other to bring the flames coming out of said holes to cross-lighting and, on the other hand, have a section/depth ratio such as to avoid the backdraft in the mix chamber. Moreover, these holes are disposed along a very specific cutting path and surface topography 9 in order to further favor said cross-lighting.

The burner is furthermore provided with secondary air orifices 6,7 located and aligned in both panels 1,3.

On the one hand, this operation allows turbulence when secondary air meets the rising flow of the burnt gases, which results in the homogenization of the fuel (gas)/oxidizer (air) mixture, and on the other hand, it allows the cooling of the flames at their base, which makes them "weaker" as compared to real wood or coal flames.

The burner of the invention can be advantageously provided with a deflector made in the same material, i.e. rigid gel-cast ceramics (not shown). This deflector is specifically adapted to said burner and has oxidizing properties, which render the flue gases cleaner.

A further surprising and unexpected advantage of the invention lies in the discovery that the use of such a deflector provides a reduction of carbon dioxide content in the flue gases, as mentioned above.

The invention claimed is:

1. A multi-panel device of a gas burner capable of bringing artificial fuel disposed thereon to incandescence and configured to be connected to a venturi tube supply system, wherein said multi-panel device is made from gel-cast ceramic fibers, the device comprising:

a first upper panel and a second lower panel, the first and second panels each comprising two substantially flat parallel surfaces, and the second panel defines a flat inner volume hollowed out at an upper surface, wherein a lower surface of the upper panel is air tightly fastened to the upper surface of the lower panel during manufacturing, creating an inner volume usable as a mix chamber of primary air and fuel; wherein the first panel includes a plurality of orifices providing fluid communication to ambient air and configured to bring flames to the surface of the burner;

a receptacle fastened to said lower panel and having a port for mating with said venturi tube supply system to provide primary air and fuel to the burner by gas injection;

means for horizontally bringing secondary air to the front and back on the upper panel, wherein said means comprise aligned orifices in the upper and lower panels, each said panel containing at least one of said orifices, and wherein the means are not in communication with the mix chamber.

2. The device according to claim 1, wherein the gel-cast ceramic fibers comprise ceramic fibers soluble in physiological fluids or of ceramic fibers with low biopersistence.

3. The device according to claim 1, wherein the multi-panel device is covered by a deflector panel in gel-cast or biosoluble ceramic fibers for a reduction of carbon dioxide content in the flue gases and for oxidation of the flue gases.

4. The device according to claim 1, wherein said artificial fuel comprises wood or coal made of heat-resistant concrete or refractory fibers.

5. The device according to claim 1, wherein the orifices in the upper panel are aligned along a predetermined path such that adjacent orifices bring light coming out of the orifices in a cross-lighting pattern.

6. The device according to claim 1, wherein the multi-panel device is covered by a deflector panel in gel-cast or biosoluble ceramic fibers for a reduction of carbon dioxide content in the flue gases and for oxidation of the flue gases.

7. A gas burner comprising a multi-panel device according to claim 1.

8. A multi-panel device of a gas burner capable of bringing artificial fuel disposed thereon to incandescence and configured to be connected to a venturi tube supply system, wherein said multi-panel device is made from gel-cast ceramic fibers, the device comprising:

a first upper panel, a second intermediate panel and a third lower panel, the first, second and third panels each comprising two substantially flat parallel surfaces, and the second panel defines a flat inner volume hollowed out at an upper surface, wherein a lower surface of the first panel is air tightly fastened to the upper surface of the third panel during manufacturing, creating an inner volume usable as a mix chamber of primary air and fuel; wherein the first panel includes a plurality of orifices providing fluid communication to ambient air and configured to bring flames to the surface of the burner;

a receptacle fastened to said third panel and having a port for mating with said venturi tube supply system to provide primary air and fuel to the burner by gas injection;

means for horizontally bringing secondary air to the front and back on the first panel, wherein said means comprise aligned orifices in the first, second and third panels, each said panel containing at least one of said orifices, and wherein the means are not in communication with the mix chamber.

9. The device according to claim 8, wherein the orifices in the first panel are aligned along a predetermined path such that adjacent orifices bring light coming out of the orifices in a cross-lighting pattern.

10. The device according to claim 8, wherein the gel-cast ceramic fibers comprise ceramic fibers soluble in physiological fluids or of ceramic fibers with low biopersistence.

11. The device according to claim 8, wherein said artificial fuel comprises wood or coal made of heat-resistant concrete or refractory fibers.

12. A gas burner comprising a multi-panel device according to claim 8.

* * * * *